US010001797B2

(12) United States Patent
Sabbineni et al.

(10) Patent No.: US 10,001,797 B2
(45) Date of Patent: Jun. 19, 2018

(54) SPACE AND POWER-SAVING MULTIPLE OUTPUT REGULATION CIRCUITRY

(71) Applicant: SanDisk Technologies LLC, Plano, TX (US)

(72) Inventors: Srinivasa Rao Sabbineni, Bangalore (IN); Bhavin Odedara, Bangalore (IN); Jayanth Mysore Thimmaiah, Bangalore (IN)

(73) Assignee: SanDisk Technologies LLC, Plano, TX (US)

( * ) Notice: Subject to any disclaimer, the term of this patent is extended or adjusted under 35 U.S.C. 154(b) by 0 days. days.

(21) Appl. No.: 15/218,566

(22) Filed: Jul. 25, 2016

(65) Prior Publication Data

US 2018/0024581 A1 Jan. 25, 2018

(51) Int. Cl.

*G05F 1/56* (2006.01)
*G05F 1/577* (2006.01)
*G05F 1/595* (2006.01)

(52) U.S. Cl.

CPC ..... *G05F 1/577* (2013.01); *G05F 1/595* (2013.01)

(58) Field of Classification Search

CPC ..... G05F 1/56; G05F 1/577; G05F 1/595
USPC ..... 323/271–285, 315
See application file for complete search history.

(56) References Cited

U.S. PATENT DOCUMENTS 5,493,205 A * 2/1996 Gorecki ..... G05F 3/262 323/315
7,218,087 B2 * 5/2007 Lin ..... G05F 1/575 323/280
7,414,468 B2 * 8/2008 Yamaji ..... H03F 3/193 330/295
7,994,766 B2 * 8/2011 De Lima Filho ..... H02M 3/158 323/277
8,120,426 B1 * 2/2012 Granger-Jones ..... H03F 1/0277 330/253
9,455,757 B2 * 9/2016 Tripurari ..... H03D 7/1441
2007/0057660 A1 * 3/2007 Lin ..... G05F 1/575 323/316

OTHER PUBLICATIONS

Peter Hazucha, et al., "Area-Efficient Linear Regulator with Ultra-Fast Load Regulation", IEEE Journal of Solid-State Circuits, vol. 40, No. 4, Apr. 2005, (8 pages).

* cited by examiner

*Primary Examiner* — Adolf Berhane
*Assistant Examiner* — Nusrat Quddus

(57) ABSTRACT

Regulator circuitry may include a plurality of output circuits to generate a plurality of regulated output voltages. The regulator circuitry may include a single operational amplifier and a single feedback loop for regulation, which may reduce space and power consumed by the regulator circuitry. A transconductor and current mirror circuitry may be included to generate the plurality of regulated output voltages based a single operational amplifier output voltage generated with the single operational amplifier and feedback loop.

20 Claims, 3 Drawing Sheets

SPACE AND POWER-SAVING MULTIPLE OUTPUT REGULATION CIRCUITRY

BACKGROUND

Regulator circuitry of an electronic system may include regulators that are configured to generate regulated output voltages. Regulators may be included because the supply voltage that would otherwise be used to power the circuit components of the electronic system may be too noisy and/or at a level that is not as stable or constant as desirable. An electronic system may be configured such that it may not be desirable for a single regulator to supply a regulated output voltage to different circuit components of the electronic system. For example, different circuit components may operates at different voltage levels and/or one circuit component should be isolated from the noise generated by another circuit component. Accordingly, the electronic system may include multiple regulators to supply multiple regulated output voltages to the different circuit components.

The more regulators that are used, the more space of the electronic system that the regulators consume. Reducing the space that the regulators consume while maintaining the number of regulated output voltages that the regulator circuitry generates may be desirable.

BRIEF DESCRIPTION OF THE DRAWINGS

The accompanying drawings, which are incorporated in and constitute a part of this specification illustrate various aspects of the invention and together with the description, serve to explain its principles. Wherever convenient, the same reference numbers will be used throughout the drawings to refer to the same or like elements.

DETAILED DESCRIPTION OF PRESENTLY PREFERRED EMBODIMENTS

Overview

Figure 1:
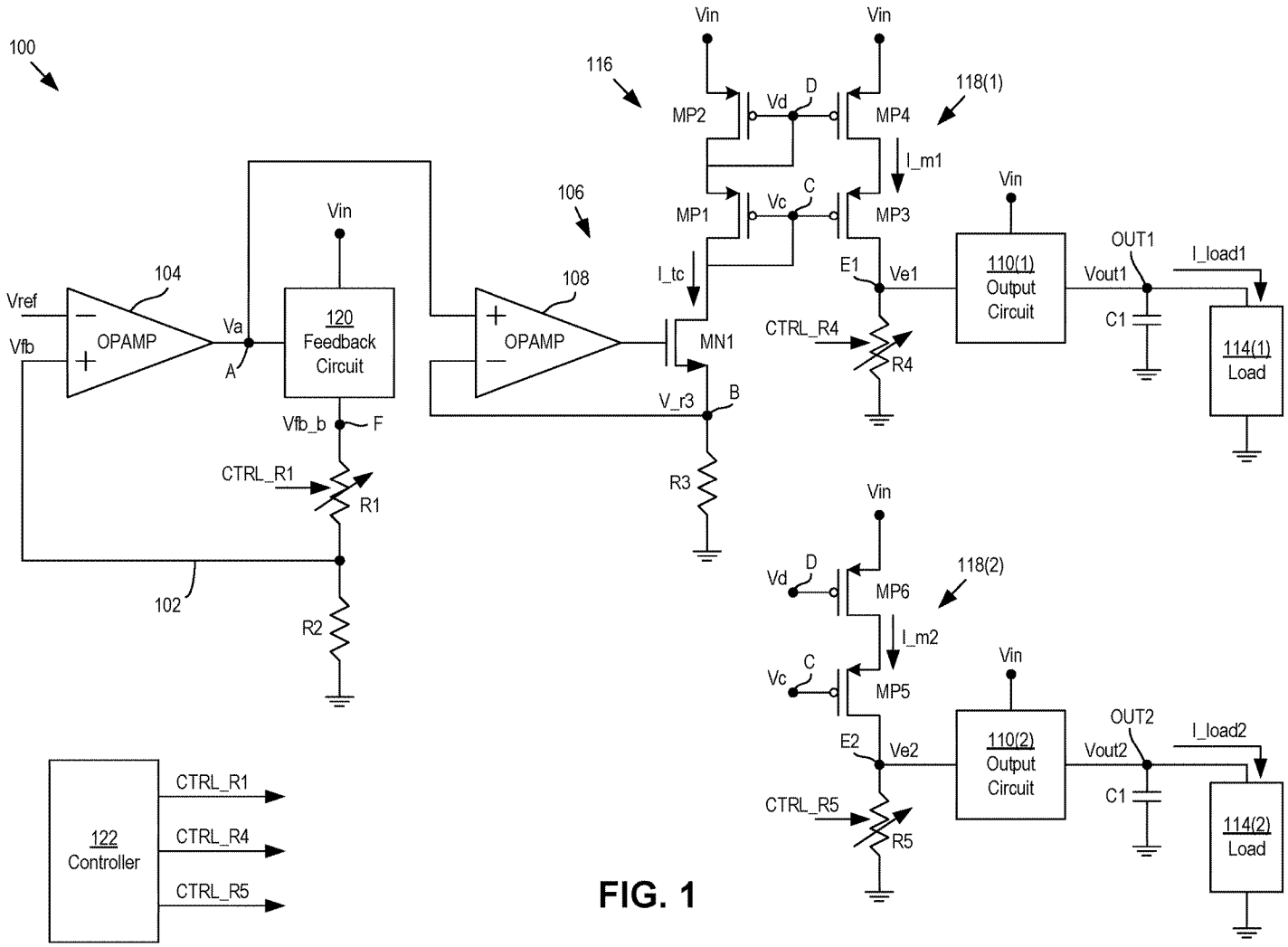
FIG. 1 is a circuit schematic diagram of an example multiple output regulation circuitry.

As mentioned in the background section, the more regulators that are used for an electronic system's regulation circuitry, the more space and power that the regulation circuitry consumes. The present description describes regulator circuitry that is configured to generate a plurality of regulated output voltages through use of a single feedback loop, or at least a fewer number of feedback loops than regulated output voltages that are generated. In one example embodiment, a regulator circuitry includes a transconductor circuit, current mirror circuitry, and a plurality of output circuits. The transconductor circuit is configured to generate a transconductor current based on an amount of difference between a reference voltage and a feedback voltage. The current mirror circuitry is configured to generate a plurality of mirrored currents based on the transconductor current. The plurality of output circuits are configured to generate a plurality of regulated output voltages based on the plurality of mirrored currents.

In some embodiments, the current mirror circuitry comprises cascode current mirror circuitry.

In some embodiments, the current mirror circuitry comprises a plurality of output arms equal in number to a number of the plurality of output circuits.

In some embodiments, the current mirror circuitry is configured to supply the plurality of mirrored currents to a plurality of resistors, where each of the plurality of regulated output voltages is generated based on a corresponding one of the plurality of resistors.

In another embodiment, regulator circuitry includes an operational amplifier, a feedback loop, and a plurality of output circuits. The operational amplifier is configured to generate an operational amplifier voltage in response to receipt of a feedback voltage and a reference voltage. The feedback loop is configured to generate the feedback voltage based on a first resistor and a second resistor. Each of the plurality of output circuits is configured to generate one of a plurality of regulated output voltages based on the first resistor and the second resistor.

In some embodiments, the regulator circuitry further includes a transconductor circuit coupled to an output of the operational amplifier and configured to generate a transconductor current, and a feedback circuit coupled to the output of the operational amplifier and configured to generate a feedback circuit output voltage for generation of the feedback voltage. The plurality of output circuits are configured to generate the plurality of regulated output voltages further based on the transconductor current. In addition, the operational amplifier is configured to provide the operational amplifier voltage to both the transconductor circuit and the feedback circuit.

In some embodiments, the regulator circuitry further includes current mirror circuitry configured to generate a plurality of mirrored currents based on the transconductor current, and supply the mirrored currents to the output circuitry for generation of the plurality of regulated output voltages.

In another embodiment, a method is performed. The method includes: generating, with an operational amplifier circuit, an amplifier output voltage in response to receiving a reference voltage and a feedback voltage; generating, with a transconductor circuit, a transconductor current based on the operational amplifier output voltage; mirroring, with current mirror circuitry, the transconductor current to generate a plurality of mirrored currents; supplying, with the current mirror circuitry, the plurality of mirrored currents to a plurality of output circuits; and generating, with the plurality of output circuits, a plurality of regulated output voltages based on the plurality of mirrored currents.

In some embodiments, the method further includes: supplying the operational amplifier output voltage to the transconductor circuit and a feedback circuit that generates, based on the operational amplifier output voltage, a feedback circuit output voltage on a feedback loop that connects back to the operational amplifier circuit.

In some embodiments, generating the plurality of regulated output voltages includes: generating a plurality of voltages across a plurality resistors based on the plurality of mirrored currents; supplying the plurality of voltages to a plurality of output circuits; and generating, with the plurality of output circuits, the plurality of regulated output voltages based on the plurality of voltages.

In some embodiments, mirroring the transconductor current comprises mirroring the transconductor current a number of times equal to a number of the plurality of output circuits.

In another embodiment, regulator circuitry includes: means for generating a transconductor current based on an amount of difference between a reference voltage and a feedback voltage; means for generating a plurality of mirrored currents based on the transconductor current; and means for generating a plurality of regulated output voltages based on the plurality of mirrored currents.

Other embodiments are possible, and each of the embodiments can be used alone or together in combination. Accordingly, various embodiments will now be described with reference to the attached drawings.

Exemplary Embodiments

The present description describes regulator circuitry that is configured to generate a plurality of regulated output voltages through use of a single feedback loop, or at least a fewer number of feedback loops than regulated output voltages that are generated. A lower number of feedback loops may reduce the overall size of the regulator circuitry as well as reduce power consumption. Such size and performance enhancements may be desirable for various electronic systems or apparatuses that generate multiple regulated output voltages, such as systems that include integrated circuits or systems on a chip (SoC). Such systems may utilize multiple regulated output voltages for various reasons, such as because the system includes circuit components that operate in different power domains, it is desirable for one circuit component to not be affected by the noise generated by another circuit component, and/or that the system employs dynamic voltage scaling (DVS) within one or more of the power domains.

FIG. 1 shows a circuit schematic diagram of example multiple output regulator circuitry 100 that is configured to generate a plurality of regulated output voltages Vout. FIG. 1 shows two regulated output voltages being generated, Vout1 an Vout, although the circuit configuration shown in FIG. 1 can be modified to generate an N-number of regulated output voltages Vout1 to VoutN, where N is two or greater, as described in further detail below.

The regulator circuitry 100 may include a single feedback loop 102 that provides a feedback voltage Vfb to an input of an operational amplifier (OPAMP) circuit 104 in order to generate the plurality of regulated output voltages Vout. The operational amplifier circuit (OPAMP) 104 may generate an output voltage Va at a node A at a level that is indicative of, corresponds to, and/or is proportional to an amount of difference between the feedback voltage Vfb with a reference voltage Vref. In the example configuration shown in FIG. 1, reference voltage Vref is supplied to a negative input terminal and the feedback voltage Vfb is supplied to a positive input terminal of the operational amplifier circuit 104. The level of the operational amplifier output voltage Va may be based on, such as proportional to, a difference between the feedback voltage Vfb and the reference voltage Vref. In some example configurations, the reference voltage Vref may be generated with a bandgap voltage generator, which may be part of the same system as (e.g., on chip with) the regulator circuitry 100, or external to (e.g., off chip from) the system in which the regulator circuitry 100 is implemented.

Although a single feedback loop 102 is shown in FIG. 1, other example configurations may include multiple feedback loops, where the number of feedback loops is less than the number of output voltages Vout being generated. Physically, the feedback loop 102 consumes a certain amount of space or area. Multiple output regulator circuitry configurations that include only a single feedback loop 102 or at least a fewer number of feedback loops than regulated output voltages Vout may consume less area than other multiple output regulator circuitry configurations that have the same number of feedback loops as the number of regulated output voltages Vout. Also, fewer feedback loops may result in less power consumption.

The regulator circuitry 100 may further include a transconductor circuitry 106 that is configured to generate a transcondutor current I_tc. In the example configuration shown in FIG. 1, the transconductor circuitry 106 may include an operational amplifier circuit 108 and a n-channel metal-oxide-semiconductor field effect (NMOS) transistor MN1. The output voltage generated by the operational amplifier circuit 108 may bias a gate terminal of the NMOS transistor MN1, which may cause the NMOS transistor MN1 to turn on and generate the transconductor current I_tc, which may be a drain-to-source current of the NMOS transistor MN1. A source terminal of the NMOS transistor MN1 may be connected to an end of a resistor R3 at a node B. As used herein, the term resistor may refer to a single resistor, a plurality of resistors connected in any combination of series and/or parallel combinations, other similar types of passive circuit components that provide a resistance that reduces current flow and/or lowers voltage levels within a particular circuit, or combinations thereof. The resistor R3 may also have an end connected to ground, as shown in FIG. 1. When the NMOS transistor MN1 is turned on, the transconductor current I_tc may flow through the NMOS transistor M3 to the resistor R3, and a voltage V_r3 may be generated across the resistor R3 based on the transconductor current I_tc.

As shown in FIG. 1, the voltage V_r3 may be supplied back to a negative input terminal of the operational amplifier circuit 108. In addition, the operational amplifier voltage Va generated at node A may be supplied to a positive input terminal of the operational amplifier circuit 108. Accordingly, the level of the output voltage of the operational amplifier circuit 108, and in turn the amount of the transconductor current I_tc may depend on and/or be proportional to the amount of difference between the operational amplifier voltage Va and the voltage generated across resistor R3.

The regulator circuitry 100 may further include a plurality of output circuits 110. Each output circuit 110 may be configured to generate one of the plurality of regulated output voltages Vout. As previously described, the regulator circuitry 100 shown in FIG. 1 is configured to generate two regulated output voltages Vout1 and Vout2. Accordingly, the regulator circuitry 100 is shown as including a first output circuit 110(1) configured to generate the first regulated output voltage Vout1 at a first output node OUT1 and a second output circuit 110(2) configured to generate the second regulated output voltage Vout2 at a second output node OUT2. In general, regulator circuitry of the present description may include an N-number of output circuits 110(1) to 110(N) to generate an N-number of regulated output voltages Vout(1) to Vout(N).

Additionally, as shown in FIG. 1, decoupling capacitors C1, C2 may be connected in shunt to respective output nodes OUT1, OUT2. Additionally, each of the output nodes OUT may be coupled to an associated load 114. For example, the first output node OUT1 may be coupled to a first load 114(1) and the second output node OUT2 may be coupled to a second load 114(2). A first load current I_load 1 generated based on the first regulated voltage Vout1 may be supplied to the first load 114(1) and similarly, a second load current I_load 2 generated based on the second regulated voltage Vout2 may be supplied to the second load 114(2).

In addition, the regulator circuitry 100 may include current mirror circuitry that is configured to generate a plurality of mirrored circuits I_m in order to generate the plurality of regulated output voltages Vout. The current mirror circuitry may include an input arm 116 coupled to the transconductor circuitry 106 and a plurality of output arms 118 configured to generate the plurality of mirrored currents I_m. The number of output arms 118 may correspond and/or be equal to the number of regulated output voltages Vout being generated. For example, in FIG. 1, a first output arm 118(1) may be configured to generate a first mirrored current I_m1 for generation of the first regulated output voltage Vout1 and a second output arm 118(2) may be configured to generate a second mirrored current I_m2 for generation of the second regulated output voltage Vout2. In general, the current mirror circuitry may be configured with an N-number of output arms 118(1) to 118(N) for generation of an N-number of regulated output voltages.

As shown in FIG. 1, the input and output arms 116, 118 of the current mirror circuitry may be configured with p-channel metal-oxide-semiconductor field effect (PMOS) transistors. The sizes of the PMOS transistors may be matched appropriately in order for the mirrored currents I_m to be generated at desired levels. Also, in the example configuration shown in FIG. 1, the current mirror circuitry is configured in a cascode configuration. For the input arm 116, a source terminal of a first PMOS transistor MP1 may be connected to a drain terminal of a second PMOS transistor MP2. Similarly, for the first output arm 118(1), source terminal for a third PMOS transistor MP3 may be connected to a drain terminal of a fourth PMOS transistor MP4, and for the second output arm 118(2), a source terminal of a fifth PMOS transistor MP5 may be connected to a drain terminal of a sixth output arm MP6. In other examples, configurations other than a cascode configuration may be implemented. For example, each of the arms 116, 118 may include a single PMOS transistor rather than a pair of cascode-connected PMOS transistor. However, the cascode configuration may provide improved accuracy in the levels of the mirrored currents I_m compared to other configurations.

A drain terminal of the first PMOS transistor MP1 may be connected to the drain terminal of the NMOS transistor MN1. In this way, the transconductor circuitry 106 may provide a constant current source for the input arm 116. When the NMOS transistor MN1 turns on, the voltage at its drain terminal (and the source terminal of the first PMOS transistor MP1) may be at relatively low level. The first PMOS transistor MP1 may be configured as a diode-connected transistor, meaning its drain and gate terminals are connected or tied together, and so the voltage generated at the drain terminal of the first PMOS transistor MP1 is also generated at the gate terminal of the first PMOS transistor MP1. This voltage is denoted in FIG. 1 as voltage Vc generated at node C. The gate voltage Vc at node C may be lower than the voltage at the source terminal of the first PMOS transistor MP1, which may cause the first PMOS transistor to turn on.

The second PMOS transistor MP2 may also be a diode-connected transistor, and so the voltage generated at the source terminal of the first PMOS transistor MP1 may also be generated at the drain and gate terminals of the second PMOS transistor MP2. This voltage is denoted in FIG. 1 as voltage Vd generated at node D. The source terminal of the second PMOS transistor MP2 may be connected to an input voltage Vin. The level of the input voltage Vin may be greater than the voltage Vd at the gate terminal of the second PMOS transistor, which in turn may cause the second PMOS transistor MP2 to turn on as well. Accordingly, the transconductor current T_tc may flow from the source terminal of the second PMOS transistor MP2 through the second PMOS transistor MP2, the first PMOS transistor MP1, and the NMOS transistor MN1 to the resistor R3. The input voltage Vin may be supplied externally from the regulator circuitry 100 and/or from an integrated circuit or system on a chip (SOC) on which the regulator circuitry 100 is being implemented.

As shown in FIG. 1, a gate terminal of the third PMOS transistor MP3 of the first output arm 118(1) may be tied to the gate terminal of the first PMOS transistor MP1 at node C and configured to receive the voltage Vc. Similarly, the gate terminal of the fourth PMOS transistor MP4 may be tied to the gate terminal of the second PMOS transistor MP2. Provided that the sizes of the third and fourth PMOS transistors MP3, MP4 are matched proportionately to the sizes of the first and second PMOS transistors MP1, MP2, the third and fourth PMOS transistors may mirror the transconductor current I_tc to generate a first mirrored current I_m1 at a level proportional to the level of the transconductor current I_tc based on the size proportionalities of the PMOS transistors MP1, MP2, MP3, MP4.

The first mirrored current I_m1 may flow through the third and fourth transistors MP3, MP4 to a resistor R4, which may cause a voltage Ve1 to be generated across the resistor R4 at a node E1. An input of the first output circuit 110(1) may also be coupled to node E1, such that the voltage Ve1 generated at node E1 is the input voltage to the first output circuit 110(1). Accordingly, the first output circuit 110(1) may generate the first regulated output voltage Vout1 based on the voltage Ve1 generated across the resistor R4 at node E1.

The second output arm 118(2) may be configured and operate similarly to that of the first output arm 118(1). The gate terminal of the fifth PMOS transistor MP5 may be connected to the gate terminal of the first PMOS transistor MP1 at node C and configured to receive the voltage Vc. Similarly, the gate terminal of the sixth PMOS transistor MP6 may be connected to the gate terminal of the second PMOS transistor MP2 at node D and configured to receive the voltage Vd. Like the third and fourth PMOS transistors MP3, MP4, the fifth and sixth PMOS transistors MP5 and MP6 may be sized proportionately to that of the first and second PMOS transistors MP1, MP2 to generate the second mirrored current I_m2 at a level proportionate to that of the transconductor current I_tc.

The second mirrored current I_m2 may flow through the fifth and sixth transistors MP5, MP6 to a resistor R5, which may cause a voltage Ve2 to be generated across the resistor R5 at a node E2. An input of the second output circuit 110(2) may also be coupled to node E2, such that the voltage Ve2 generated at node E2 is the input voltage to the second output circuit 110(2). Accordingly, the second output circuit 110(2) may generate the first regulated output voltage Vout based on the voltage Ve2 generated across the resistor R5 at node E2.

As previously described, other example configurations of the regulator circuitry 100 may be configured to generate more than two regulated output voltages. In general, the regulator circuitry of the present description may generate an N-number of regulated output voltages Vout1 to VoutN. To do so, the regulator circuitry may include an N-number of output arms 118(1) to 118(N). For configurations where the current mirror circuitry has a cascode configuration, each output arm may include a pair of cascode-connected PMOS transistors, with one of the PMOS transistors having a gate terminal connected to node C and the other PMOS transistor having a gate terminal connected to node D. Each of the N-number of output arms may supply a mirrored current to a corresponding resistor, and in response a voltage Ve may be generated across the resistor at a node E. That voltage Ve may be the input voltage to a corresponding output circuit 110, which in turn may use that voltage Ve to generate one of the plurality of regulated output voltages Vout.

As shown in FIG. 1, the regulator circuitry 100 may also include a feedback circuit 120 having an input coupled to the output of the operational amplifier circuit 104. Accordingly, the operational amplifier circuit 104 may be configured to provide the operational amplifier output voltage Va to both the feedback circuit 120 and the operational amplifier circuit 108. In response to the operational amplifier output voltage Va, the feedback circuit 120 may generate a feedback circuit output voltage Vfb_b at a node F.

The feedback circuit output voltage Vfb_b may be used for generation of the feedback voltage Vfb that is sent back to the positive input terminal of the operational amplifier circuit 104. As shown in FIG. 1, the regulator circuitry 100 may include a resistor divider network, which may include a resistor R1 and a resistor R2. The resistor R1 may have a first end connected to the output of the feedback buffer 120 at node F and a second end connected to the positive input terminal of the operational amplifier circuit 104. The second resistor R2 may have a first end connected to the positive input terminal of the operational amplifier circuit 104 and a second end connected to ground. Accordingly, the feedback voltage Vfb may be equal to the feedback circuit output voltage Vfb_b times the resistance of the resistor R2 divided by the sum of the resistance of the resistor R1 and the resistance of the resistor R2, or mathematically: Vfb=Vfb_b*(R2/(R1+R2)).

The feedback circuit 120 and the resistors R1 and R2 may be considered part of the feedback loop 102. Through use of the feedback buffer 120 and the resistors R1 and R2, the regulation aspect of the regulator circuitry 100 is performed based on a voltage (i.e., the feedback circuit output voltage Vfb_b) generated before the output stage of the regulator circuitry 100, as opposed to other regulators that may perform the regulation using the regulated output voltages Vout themselves.

In some example configurations, the feedback circuit 120 may be considered a replica circuit, in that it has the same configuration as (i.e., is a replica of) the output circuit 110.

Figure 2:
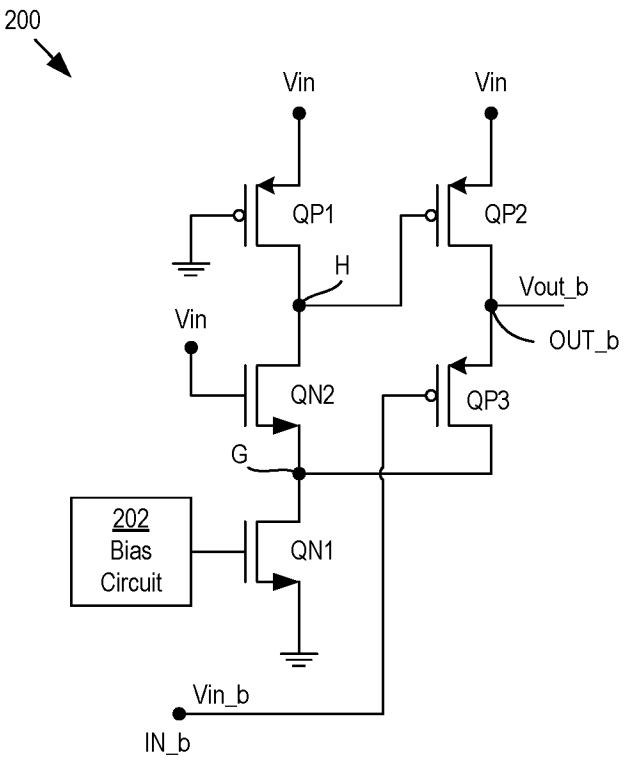
FIG. 2 is a circuit schematic diagram of an example buffer circuit of FIG. 1.

Additionally, in some example configurations, the output circuits 110 and the feedback circuit 120 may be buffer circuits. FIG. 2 shows a circuit schematic of a buffer circuit 200, which may be the circuit configuration for the output circuits 110 and the feedback circuit 120. The buffer circuit 200 may include a first NMOS transistor QN1, a second NMOS transistor QN2, a first PMOS transistor QP1, a second PMOS transistor QP2, and a third PMOS transistor QP3. The first NMOS transistor's QN1 source terminal may be connected to ground, and its gate terminal may be connected to a bias circuit 202. The bias circuit may be any circuit configured to generate a desired bias voltage on the gate terminal of the first NMOS transistor QN1. The drain terminal of the first NMOS transistor QN1 may be connected to the source terminal of the second NMOS transistor QN2 at a node G. The drain terminal of the third PMOS transistor QP3 may also be connected to node G. The gate terminal of the second NMOS transistor QN2 may be connected to the input voltage Vin. The drain terminal of the second NMOS transistor QN2 may be connected to the drain terminal of the first PMOS transistor QP1 and the gate terminal of the second PMOS transistor QP2 at a node H. The first PMOS transistor's QP1 gate terminal may be connected to ground. The source terminals of both the first and second PMOS transistors QP1, QP2 may be connected to the input voltage Vin.

The drain terminals of the second PMOS transistor QP2 and the third PMOS transistor MP3 may be connected together at a buffer output node OUT_b where a buffer output voltage Vout_b of the buffer circuit 200 may be generated. For configurations where the buffer circuit 200 is implemented as an output circuit 110 in FIG. 1, then the buffer output voltage Vout_b is one of the regulated output voltages Vout of the regulator circuitry 100. For configurations where the buffer circuit 200 is implemented as the feedback circuit 120, then the buffer output voltage Vout_b is the feedback circuit output voltage Vfb_b. The gate terminal of the third PMOS transistor QP3 may be configured to receive a buffer input voltage Vin_b at a buffer input node IN_b. For configurations where the buffer circuit 200 is implemented as an output circuit 110 in FIG. 1, then the buffer input voltage Vin_b is one of the voltages Ve generated at a node E. For configurations where the buffer circuit 200 is implemented as the feedback circuit 120, then the buffer input voltage Vin_b is the operational amplifier output voltage Va generated at node A.

In operation, the buffer circuit 200 functions as a unity gain buffer. Single-stage regulation without inversions and associated poles is implemented by a super source follower combination of the second PMOS transistor QP2 and the second NMOS transistor. The quiescent current may be set by the first NMOS transistor QN1 and the first PMOS transistor QP1. The third PMOS transistor QP3 may act as a common-gate amplifier. At zero load, most of the bias current flows through the third PMOS transistor QP3 and the second PMOS transistor QP2. The second NMOS transistor QN2 may be turned off, and the second PMOS transistor QP2, which may be a large driver transistor, is turned on just enough to pass a small bias current. When the load current increases, the buffer output voltage Vout_b drops and the third PMOS transistor QP3 partially turns off. The bias current is redirected to the source terminal of the second NMOS transistor QN2 and pulls down the level of the voltage at the gate terminal of the second PMOS transistor QP2. This turns on the second PMOS transistor QP2 and the current starts flowing from the buffer input node IN_b to the buffer output node OUT_b, which in turn compensates for droop.

Referring back to FIG. 1, for alternative example configurations, one or more of the output circuits 110 and/or the feedback circuit 120 may be configured as a single NMOS transistor instead of the buffer circuit 200 of FIG. 2. However, the buffer circuit 200 may provide improved performance compared to a single NMOS transistor configuration, such as in terms of droop and dropout. In addition, when the single NMOS transistor is used, application of the feedback voltage Vfb and the reference voltage Vref to the operational amplifier 104 may be reversed. In particular, the feedback voltage Vfb is applied to the negative terminal and the reference voltage Vref is applied to the positive terminal.

The voltage levels of each of the regulated output voltages Vout may depend on the resistances of the resistors R1, R2 of the feedback loop 102. Accordingly, the regulator circuitry 100 utilizes a single feedback loop 102 and each of the regulated output voltages Vout that are generated depend on the resistances of the resistors R1, R2 of the single feedback loop. The voltage levels of each of the regulated output voltages Vout may further depend on the resistor R3 that receives the transconductor current I_tc. Additionally, each of the output voltage Vout may depend on a corresponding one of the resistors connected to an input of an associated output circuit 110. For example, the first regulated output voltage Vout1 may depend on the resistance of the resistor R4, and the second regulated output voltage Vout2 may depend on the resistance of the resistor R5. Particularly, the level of an output voltage Vout may depend on a ratio of the corresponding resistor connected to the associated output circuit 110 and the resistor R3. Mathematically, the first and second regulated output voltages may be determined according to the following equations:

$$Vout1 = \left(\frac{R4}{R3}\right)\left(\frac{R1 + R2}{R2}\right)Vref,$$

$$Vout2 = \left(\frac{R5}{R3}\right)\left(\frac{R1 + R2}{R2}\right)Vref.$$

In accordance with these equations, when the resistances of the resistors R4 and R5 are set to different levels, the regulated output voltages Vout1 and Vout2 may be generated at different levels. In this way, the regulator circuitry 100 may be configured to support electronic systems that utilize multiple voltage domains and/or that have different circuit components that operate a different voltage levels.

In addition, as shown in FIG. 1, the resistors R1, R4, and R5 may be adjustable, such as by being programmable. For example, resistances of the resistors R1, R4, R5 may be set and/or adjusted using control signals CTRL_R1, CTRL_R4, and CTRL_R5. The control signals CTRL_R1, CTRL_R4, and CTRL_R5 may each be digital signals including one or more bits, where the bit values of the digital signals may determine the resistances. A controller 122, which may be implemented in hardware or a combination of hardware and software, may be in communication with the regulator circuitry 100 and configured to generate the control signals CTRL_R1, CTRL_R4, CTRL_R5 and output them to their respective programmable resistors in order to set the resistors R1, R4, R5 at desired resistances. In some example configurations, the regulator circuitry 100 and the controller may be part of the same electronic system, such as integrated on the same integrated circuit or part of the same SoC. In other example configurations, the controller 122 may be part of a different system and/or the controller 122 and the regulator circuitry 100 may be implemented on different integrated circuits.

Additionally, in some example configurations, the resistor R1 may be utilized to change the regulated output voltages with finer granularity compared to the resistors R4 and R5. For example, the controller 122 may be configured to change the resistance of the resistor R1 in order to change the levels of the regulated output voltages on the order of hundredths of volts (e.g., in 0.01 V increments). In comparison, the controller 122 may be configured to change the resistances of the resistors R4 and R5 in order to change the levels of the regulated output voltages in 50 millivolt (mV) increments. In some example configurations, the control signal CTRL_R1 used to set the resistance of the resistor R1 may be a six-bit signal, whereas the control signals CTRL_R4 and CTRL_R5 used to set the resistances of the resistors R4 and R5 may be three-bit signals.

The adjustable aspect of the resistors R1, R4, R5 may be utilized to set two or more of the regulated output voltages Vout at different voltage levels. In addition or alternatively, one or more of the resistors R1, R4, R5 may be adjusted in order to set a single regulated voltage Vout at different levels at different points in time. For example, at one point in time, the first regulated output voltage Vout1 may be at one level, and then the controller 122 may change the resistance of the resistor R1 and/or the resistance of the resistor R4 in order to change the level of the first regulated output voltage Vout1 at a later point in time. In this way, the regulator circuitry 100 may be configured to support dynamic voltage scaling (DVS). An example application of DVS is where a circuit component operates in different power modes. The circuit component may receive a regulated voltage at one level while operating in a normal mode and then receive the regulated voltage at a lower level while operating in a low power mode. Another example of DVS may be error correction, where an error correction engine uses different power (voltage) levels for different levels or error correction capability.

In sum, the multiple output regulator circuitry 100 may be configured to support an electronic system that includes different circuit components (e.g., loads 114) that use different regulated output voltages. The electronic system may use multiple regulated output voltages for various reasons. For example, different circuit components may receive different regulated voltages so one circuit component is not affected by noise produced from another circuit component and/or because the circuit components operate at different voltage levels. In addition, the regulator circuitry 100 may be configured to change the levels of each of the regulated output voltages Vout at different points in time during operation, such as for circuit components that are configured for DVS.

An example application for the regulator circuitry 100 may be an electronic system or apparatus that includes core circuitry that performs various functions of the system or apparatus, a physical layer (PHY) interface for external communication, and delay lock loop circuitry, which may be "always on" regardless of the power mode of the electronic system or apparatus. The core circuitry itself may include a portion that uses DVS and another portion that does not use DVS. Such a system may utilize four regulated output voltages, one for the DVS portion of the core, another for the non-DVS portion of the core, a third for the PHY interface, and a fourth for the DLL circuitry. The regulator circuitry 100 may be configured to include four output arms 118, four output circuits 110, and four programmable resistors coupled to respective arms 118 and the output circuits 110 in order to generate the four regulated output voltages at desired levels during the course of operation of the system. Of course, this application is a non-limiting example and other applications in which the regulator circuitry 100 may be implemented may be possible.

Figure 3:
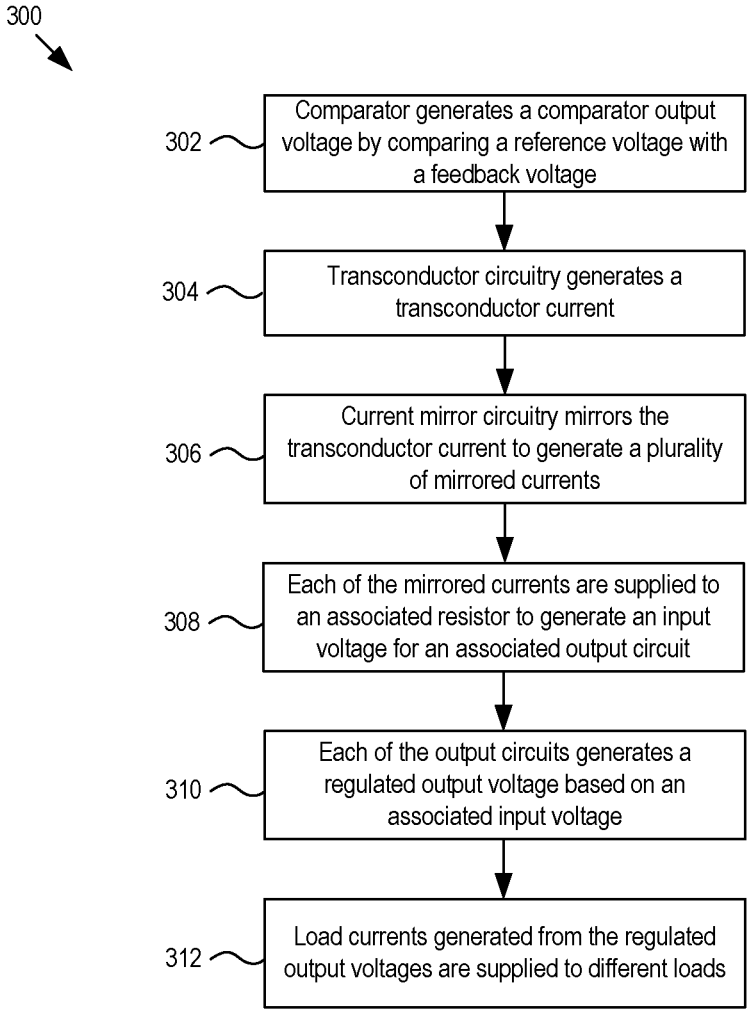
FIG. 3 is a flow chart of an example method of operating a multiple output regulator circuit.

FIG. 3 shows a flow chart of an example method 300 of operating a multiple output regulator. At block 302, an operational amplifier may generate an operational amplifier output voltage that is indicative of, corresponds to, and/or proportional to an amount of difference between a reference voltage and a feedback voltage. In some example methods, the feedback voltage may be generated by generating a feedback circuit output voltage using a feedback circuit and voltage dividing the feedback circuit output using a first resistor and a second resistor.

At block 304 a transconductor current may be generated with transconductor circuitry. In some example methods, the transconductor current may be generated with a second operational amplifier circuit that generates a second operational amplifier output voltage based on an amount of difference between the first operational output voltage and a voltage that is generated across a third resistor. The transconductor current is supplied to the third resistor in order to generate the voltage. The second operational amplifier output voltage output by the second operational amplifier circuit is applied to a gate terminal of a transistor, which turns on the transistor, causing the transconductor current to be generated and supplied to the third resistor.

At block 306, current mirror circuitry may mirror the transconductor current to generate a plurality of mirrored currents. As previously described, the current mirror circuitry may include an input arm coupled to the transconductor circuitry and a plurality of output arms, each configured to generate one of the plurality of mirrored currents. In some example methods, the current mirror circuitry used to mirror the transconductor current may have a cascode configuration.

At block 308, each of the plurality of mirrored currents may be supplied to an associated resistor in order to generate an associated voltage, which may be an input voltage to an associated one of a plurality of output circuits. At block 310, each output circuit may generate an associated one of a plurality of regulated output voltages based on receipt of the associated input voltage. At block 312, a plurality of load currents generated from the plurality of regulated output voltages may be supplied to different loads.

It is intended that the foregoing detailed description be understood as an illustration of selected forms that the invention can take and not as a definition of the invention. It is only the following claims, including all equivalents, that are intended to define the scope of the claimed invention. Finally, it should be noted that any aspect of any of the preferred embodiments described herein can be used alone or in combination with one another.

We claim:

1. Circuitry comprising:

a transconductor circuit configured to generate a transconductor current based on an amount of difference between a reference voltage and a feedback voltage;

current mirror circuitry configured to:

generate a plurality of mirrored currents based on the transconductor current; and supply the plurality or mirrored currents to a plurality of resistors; and a plurality of output circuits configured to generate a plurality of regulated output voltages based on the plurality of mirrored currents, wherein each of the plurality of output circuits is configured to generate a respective one of the regulated output voltages based on a corresponding one of the plurality of resistors.

2. The circuitry of claim 1, wherein the current mirror circuitry comprises cascode current mirror circuitry.

3. The circuitry of claim 2, wherein the cascode current mirror circuitry comprises p-channel metal-oxide-semiconductor field-effect transistors.

4. The circuitry of claim 1, wherein the current mirror circuitry comprises a plurality of output arms equal in number to a number of the plurality of output circuits.

5. The circuitry of claim 1, wherein the transconductor circuit is configured to supply the transconductor current to a second resistor, and wherein each of the plurality of regulated output voltages is generated further based on the second resistor.

6. The circuitry of claim 5, wherein the feedback voltage is generated based on a third resistor and a fourth resistor, and wherein each of the regulated output voltages is generated further based on the third resistor and the fourth resistor.

7. The circuitry of claim 5, further comprising an operational amplifier circuit configured to generate an operational amplifier voltage based on the amount of difference between the reference voltage and the feedback voltage, and wherein the transconductor circuit is configured to generate the transconductor current in response to receipt of the operational amplifier voltage and a voltage generated across the second resistor.

8. The circuitry of claim 5, wherein the plurality of resistors are adjustable.

9. Circuitry comprising:

an operational amplifier configured to generate an operational amplifier voltage in response to receipt of a feedback voltage and a reference voltage;

a feedback circuit configured to generate a feedback circuit output voltage in response to receipt of the operational amplifier voltage;

a feedback loop configured to generate the feedback voltage based on a first resistor, a second resistor, and the feedback circuit output voltage;

current mirror circuitry configured to generate a plurality of mirrored currents based on the operational amplifier voltage; and a plurality of output circuits, each configured to generate one of a plurality of regulated output voltages based on the first resistor, the second resistor, and a respective one of the plurality of mirrored currents.

10. The circuitry of claim 9, further comprising:

a transconductor circuit coupled to an output of the operational amplifier and configured to generate a transconductor current in response to receipt of the operational amplifier voltage, wherein the current mirror circuitry is configured to generate the plurality of mirrored currents based on the transconductor current.

11. The circuitry of claim 10, wherein the current mirror circuitry is configured to:

generate the plurality of mirrored currents based on the transconductor current.

12. The circuitry of claim 11, wherein the current mirror circuitry comprises cascode mirror circuitry.

13. The circuitry of claim 9, wherein the current mirror circuitry is configured to supply the plurality of mirrored currents to a plurality of third resistors, and wherein each of the plurality of regulated output voltages is generated further based on a corresponding one of the plurality of third resistors.

14. The circuitry of claim 13, wherein the transconductor circuit is configured to supply the transconductor current to a fourth resistor, and wherein each of the plurality of regulated output voltages is generated further based on the fourth resistor.

15. Regulator circuitry comprising:

means for generating a transconductor current based on an amount of difference between a reference voltage and a feedback voltage;

means for generating a plurality of mirrored currents based on the transconductor current;

means for supplying the plurality of mirrored currents to a plurality of resistors; and means for generating each of a plurality of regulated output voltages based on the plurality of mirrored currents and a corresponding one of the plurality of resistors.

16. Circuitry comprising:

an operational amplifier circuit configured to generate an amplifier output voltage in response to receipt of a reference voltage and a feedback voltage;

a transconductor circuit configured to:

generate a transconductor current in response to receipt of the operational amplifier output voltage; and supply the transconductor current to a first resistor;

current mirror circuitry configured to:

mirror the transconductor current to generate a plurality of mirrored currents; and supply the plurality of mirrored currents to a plurality of second resistors; and a plurality of output circuits, each configured to generate a respective one of a plurality of regulated output voltages based on a resistance of the first resistor and a resistance of an associated one of the plurality of second resistors.

17. The circuitry of claim 16, further comprising:

a feedback circuit configured to generate, based on the operational amplifier output voltage, a feedback circuit output voltage on a feedback loop that connects back to the first operational amplifier circuit.

18. The circuitry of claim 16, wherein the plurality of second resistors are configured to generate a plurality of voltages in response to receipt of the plurality of mirrored currents, wherein the plurality of output circuits are further configured to:

receive the plurality of voltages; and generate the plurality of regulated output voltages based on the plurality of voltages generated with the plurality of second resistors.

19. The circuitry of claim 18, wherein each of the plurality of output circuits is configured to generate the respective one of the plurality of regulated output voltages based on a ratio of the resistance of the associated one of the plurality of second resistors to the resistance of the first resistor.

20. The circuitry of claim 16, wherein the current mirror circuitry is configured to mirror the transconductor current a number of times equal to the number of the plurality of output circuits.

* * * * *